US005557869A

United States Patent [19]

Douglas

[11] Patent Number: 5,557,869

[45] Date of Patent: Sep. 24, 1996

[54] DEVICES FOR ALTERATION AND DISPLAY OF CHEMILUMINESCENT LIGHT

[76] Inventor: Andre J. T. Douglas, 1046 Brookview Ave., Westlake Village, Calif. 91361

[21] Appl. No.: 382,525

[22] Filed: Feb. 2, 1995

Related U.S. Application Data

[63] Continuation-in-part of Ser. No. 239,834, May 9, 1994, abandoned, which is a continuation of Ser. No. 975,009, Nov. 12, 1992, abandoned, which is a continuation-in-part of Ser. No. 663,365, Feb. 27, 1991, abandoned.

[51] Int. Cl.[6] ..... G09F 13/20

[52] U.S. Cl. ..... 40/542; 40/605; 362/34; 362/812

[58] Field of Search ..... 40/541, 542, 544, 40/572, 605; 362/34, 159, 812; 252/700

[56] References Cited

U.S. PATENT DOCUMENTS

| | | | |
|---|---|---|---|
| 2,624,141 | 1/1953 | Martin | 40/564 |
| 3,587,185 | 6/1971 | Deal | 40/564 |
| 4,064,428 | 12/1977 | Van Zandt | 362/34 |
| 4,379,320 | 4/1983 | Mohan et al. | 362/34 |
| 4,635,166 | 1/1987 | Cameron | 362/34 |
| 4,814,949 | 3/1989 | Elliott | 362/34 |

*Primary Examiner*—Brian K. Green

[57] ABSTRACT

An artistic display device includes a shell having a substantially flat front wall through which an optical image is to be transmitted and a rear wall disposed substantially parallel to the front wall. A body of liquid-absorbing material essentially in the shape of a flat layer. The front and rear walls of the shell have perimetrical portions that are positioned close together in a parallel relationship with the flat body of liquid-absorbing material having a perimetrical portion that is disposed between and supported by the perimetrical portions of the walls. The rear wall being also rearwardly recessed to form a compartment. At least one set of frangible vials housed in the compartment containing respectively separate liquids which vials may be broken so as to mix the liquids to provide a chemiluminescent light-generating mixture that will then saturate the liquid-absorbing body and the liquid-absorbing body then continuing to be supported from its perimetrical portion in substantially its original flat configuration. A flat light control member disposed between the flat layer of liquid-absorbing material and the front wall of the shell for modifying light that is then generated from the liquid-absorbing material and transmitted through the front wall.

11 Claims, 4 Drawing Sheets

DEVICES FOR ALTERATION AND DISPLAY OF CHEMILUMINESCENT LIGHT

CROSS-REFERENCE TO RELATED APPLICATION

This application is a continuation-in-part of my prior application Ser. No. 08/239,834 filed May 9, 1994, now abandoned; which was a file wrapper continuation of my prior application Ser. No. 07/975,009 filed Nov. 12, 1992, subsequently abandoned; which in turn was a continuation-in-part of my prior application Ser. No. 07/663,365 filed Feb. 27, 1991; and subsequently abandoned.

FIELD OF INVENTION

The instant invention relates generally to chemiluminescent devices and more particularly to devices adapted to control chemiluminescent light for display.

DESCRIPTION OF THE RELATED ART

Devices which employ the principles of chemiluminescent light have been commercially available for many years. These devices have typically been in the form of containers for chemiluminescent chemicals, used as novelty or emergency items such as shapes, balls, wands, etc. The chemiluminescent effect generates a high degree of attention, and therefore as a secondary function these items have had consumer advertising imprinted upon portions of their outer surface. The increase in such advertising is true, in spite of numerous drawbacks inherent when attempting to use these items to display distinctive logos, trademarks, etc.

Comparably display devices of gaseous tube or electric bulb type are commonly used as advertising mediums, which likewise render images visible in darkened areas. These too have inherent drawbacks limiting their scope of exhibition when considered for limited duration or single event advertising.

Display devices and signs have been heretofore available or proposed. In many cases they are bulky, fragile, noisy, and expensive devises, therefore leaving much to be desired as a limited duration or single event display device. In point of sales advertising, it is desirable to be unique, and strongly draw attention to the projected image.

Thereafter, inventors have created several types of display devices or consequently, other inventions have been used as advertizing mediums. Electronically illuminated devices as described in U.S. Pat. No. 2,298,940 to Heys (1942), and 3,978,599 to Berger (1976), both offer electronically illuminated display devices for advertizing. However both have detrimental limiting factors when considered for one-time or limited duration promotions, due to their relatively high cost to produce and operate. Including inherent restrictions limiting their dimensions to that of electrical fittings, and location to their access to electrical sources, thereby, most being of a permanent nature, whose bulk requires considerable support.

U.S. Pat. No. 4,061,910 to Rosenfeld (1977), and 3,567,987 to Myers (1971), a piece of jewelry and a wand respectively, both being containers for chemiluminescent chemicals. Both, though not initially intended, have had messages imprinted on their surfaces suffering similar drawbacks in that their surfaces restrict size and legibility, thereby, requiring close inspection to reveal their intended display.

The chemiluminescent device of U.S. Pat. No. 4,814,949 to Elliott (1989) for example, reveals a shaped container with a sealed lid creating a relatively vast cavity space, which houses chemiluminescent chemical, isolated in glass ampules, until released by crushing the ampules or vials to become mixed or activated and then saturated into an absorbent article which is the same shape as the cavity profile, in so doing the articles shape is projected as a lighted image.

Elliotts crude design utilizes a single uninterrupted recess forming a relatively vast cavity throughout its peripheral shape, having a totally unrestricted cavity volume far greater than the entire volume or mass, of its internal components. This practice immediately allows all internal components to freely move into any obscure areas or diagonals of the cavity. Once dislodged in this manner, the device is prone to unsatisfactory performance, such as component collapse and poor activation. This problem exists in all cases but becomes greatly accentuated when attempting larger or more complex shapes and cavities which are often desirable to provide an effective artistic display.

The consequences of this problem are numerous. the foremost being that the primary component in which the light emitting chemical is accumulated for display which is referred to by Elliott as the absorbent article, lacks any form of surface support that will at least physically restrict its movement between the forward and rearward surfaces of the cavity.

Furthermore, thicker absorbent require a higher volume of chemical to become saturated, therefore it is economical to use thinner materials which themselves are more likely to deform, buckle, dislodge, become misaligned or fall diagonally across the cavity, which destroys the quality of the intended light effect.

This performance is unavoidable due to the disproportionate ratio of cavity volume to component mass, and will always produce this failed result especially when attempting larger display dimensions, unless there is some way to limit the backward and forward movement of the absorbent article in Elliotts device, this design can only be compared as an inferior and crude method of displaying chemiluminescent light for artistic purposes.

Another consequence of this vast unrestricted cavity being disproportionately larger in volume than its internal components, is that the glass ampules, in which the chemiluminescent chemical is isolated and contained prior to activation become more difficult to locate. This is because they themselves are unrestricted in the cavity, and are able to move about freely.

The potential for failed activation exists, because, in cases when there are more than one pair of these ampules, it is likely to miss one or two of the ampules during activation, and in such cases, a disproportionate or delayed mix will occur, which detrimentally increases the time it takes to activate the chemiluminescent light for suitable presentation.

Another activation failure, is that without restriction, these glass ampules are able to collect in one area of the shape, and subsequently be crushed or activated only in this area, in so doing, the majority of the chemical will be absorbed in this area, the chemical and its light will then be inclined not to quickly spread evenly to all extremities of the absorbent, for best results it is expected that even spread to all areas should occur in a reasonably short period of time for satisfactory activation, and therefore initial points of release are of the utmost concern to quickly achieve a presentable even light.

Elliott also teaches limitations, in that, the internal image or light shape projected is substantially the same shape as the outer shell itself, and should emit light uniformly across its entire surface.

This mono-tonic attitude is specified by several critical design limitations, which dictate that, the absorbent article must enhance light evenly, without variation throughout its entire surface area, and be of substantially the same shape as the outer shell. This strict practice demonstrates that Elliotts intended device could only provide a shaped container which projects a mono-tonic light throughout its forward facing surface, without any variation in shade or color.

There are many instances which greatly benefit from internal combinations of light contrasts and independent shape, when attempting to replicate any distinct or complex image, however Elliotts vast cavity design cannot fully control any internal components position, therefore attempts to contrast shapes and images internally are simply out of the question.

Another unfortunate result of Elliotts teaching, is that by insisting on this uniform light density across the absorbent surface, there is subsequently, no simple way to remove unwanted or excess light which may exist internally in certain areas of a shape, without having to create a complex and relatively expensive outer shell.

For example, given these teachings, if Elliott were to attempt to create the letter "O", with the intention that only the letters shape be clearly displayed. Being that only the letters framework itself become illuminated. Then Elliotts outer shell will have-to be produced with a hole through the center, in order to effectively remove the excess light from its center area.

This is a relatively simple image, yet, Elliott will require more complicated production tooling to create the extra cut out area. Consider then, the ramifications, when attempting a slightly more complex shape such as a letter "B", now there exists two holes, or worse yet, attempt a shape with several uniquely shaped and sized holes within the boundaries of a single outline.

This eventually becomes economically unattractive, and without Elliott having some way to effectively control this excess light, before it has the opportunity to be emitted from the internal confines, or unwanted areas of the shape, Elliotts resulting product will be ineffective as a true artistic display.

When considering the combined effects of these problems experienced in Elliotts teachings, it becomes apparent that Elliotts device is better suited to that of small novelties rather than attempting the complexities of larger more diverse aspects required for artistic display.

In fact, Elliotts teachings cannot even ensure activation repeatability, from one identical device to another.

Among other limitations in this design, Elliott uses one side of the device to provide support for device exhibition. This is taught to be achieved by applying a double-sided adhesive tape to a side, and once the device is activated, the second side of the tape is removed and the device can then be stuck to a flat surface for display.

The downfall of this technic is that, only one side of the device can be viewed or utilized at any given time, and therefore, wasting the potential of simultaneously using the other side for a second or independent display.

Once again Elliotts teaching does not recognize this double-sided option, because, there is a strict requirement that the absorbent conform exactly to the inner surface of the "front" shell for best result. Therefore, not only is it impossible to achieve the same good result when simultaneously viewed from the opposite side, but, also impossible to achieve an effective double sided display.

There are many short comings in Elliotts design and others heretofore proposed when considering the many needs of an illuminated, limited duration artistic display, such as the ability to produce variations in physical size, complexity of shape, distinct detail, light contrast, multi-color display, projection control, repeatability of operation, and exhibition variation.

Accordingly, industry is continually on the lookout for chemiluminescent devices, which overcome most, if not all, of the deficiencies mentioned above, which devices provide effective replication of distinctive images often required by the consumer, and are relatively simply manufactured by the manufacturer.

SUMMARY OF INVENTION

There is disclosed herein an improved display for the systematic alteration and control of emitted chemiluminescent light, which overcomes many of the deficiencies of prior art disclosed devices, accordingly several objects and advantages of my invention are outlined as follows;

The principle object of my invention is to provide a device, having several systematic features, that may be optionally combined and applied to the design of an illuminated artistic display, it is then possible to produce a chemiluminescent device of greater physical variation, demonstrating superior display control during activation and operation.

Matters such as shape, size, shade, color, exhibition and interconnection, are addressed by implementing combinations of these specific features as a system, each of which complements and assists the performance of the other, and whose collective assembly accommodates the specific requirements of a unique image to be projected in a lighted form.

It is one main object to provide an outer shell that is not only multi-functional and imperviously sealed to form a container, but that the container mirrors the protruding profiles of the internal components in places, primarily to control the position of its internal components, each confined in mirrored outwardly protruding recesses or compartments designed to coincide directly with the physical profile and displacement of the respective component thus creating in essence a minimal cavity design which bolsters the internal position or the components.

One advantage of this technique, is that internal component collapse and migration is effectively kept in check, because multiple portions of the front and rear walls or shells are parallel or in close contact with the internal components, hence these internal components are supported simultaneously by the front and rear walls, thus affording greater physical diversity and choice in shape, size, and material types.

Another advantage to mirroring the protruding profiles of the internal components, is that the activation process becomes more precise, due to easily recognized outward protrusions or recessed areas within the walls which contain the necessary internal chemical components awaiting activation, thus ensuring proportionate chemical mix, especially in complex or larger shapes.

A further advantage of such minimal cavity shell design, is that strategic placement of the components within the walls, makes it possible to achieve reasonably even points of chemical release for saturation into other internal components, thus resulting in a device with repeatable and predictable activation. Yet another advantage of such minimal cavity shell design, is that because the two part chemiluminescent chemical is released into relatively smaller confines of the outward recesses or compartments within the device, the chemical is forced to mix more thoroughly.

This multi-functional shell, is not only capable of the above mentioned active controls of its internal components, but the device also demonstrates a distinctive support or propping technique by adapting areas of the extreme periphery or flange area which may be extended further outwardly and beyond the boundary of its impervious seal, resulting in a device with potentially unlimited exhibition and support qualities.

One advantage of this extended flange function, is that this area may be utilized as a point of attachment, suspension or support, by shaping or forming the extensions upper edge to facilitate becoming merged, joined, interconnected, linked, fixed, bonded, overlapped or combined, thus creating unlimited variation of exhibition and support, with the option to form part of larger or continuous type displays.

Another advantage of this extended flange function, is that by using this area as a support or attachment area, consequently all sides become free and visually unobstructed, to then provide the option of viewing or projecting its lighted image from either side, thus creating a multi-sided display. Another primary object of my invention, is to provide a multi spectrum type internal light control technique's for the visual enhancement or suppression of the internally contained chemiluminescent chemical.

One advantageous light controlling technique, is to adjust the light reflecting and refracting characteristic of the liquid-absorbent material layer itself, not only to enhance this absorbed light, but in some cases, to suppress or negate areas of the light.

This effect may be achieved by using a liquid-absorbent material which is of a lighter highly reflective mass to enhance absorbed light, or using a liquid-absorbent material of darker non-reflective mass which will suppress or hide the absorbed light within itself.

Another advantageous internal light controlling technique which effectively defuses the light after it has emanated from the liquid-absorbent, is by providing parallel layers of materials of varying transparency, and whose color may be dissimilar to that of the originating chemical light. The result would be to alter or change the visual color effect of the light emanating from the liquid-absorbent material in the area under the parallel layers influence, and which in turn, because of its potentially independent shape to that of the liquid-absorbent materials own primary shape, it may then provide independent images within the overall lighted effect of a single device.

A further object of my invention, is that the optional combination of the above light controlling techniques, once assembled as required, in variations of overlapping and side by side configurations, it is then possible to internally achieve any display design or effect of light contrasting and alteration required to produce an artistic display.

Therefore in application of the above mentioned techniques it is also possible to isolate light in certain areas, separate light from side to side, vary its shade, color, and density across any area of a single display device.

And so in creating an artistic display device whose shell actually mirrors the outwardly protruding or parallel contours of its internal components, essentially creating a cavity of relatively minimal proportions, resulting in full control and support of those internal components. Only then do the above mentioned color controlling techniques and applications become possible each of which each depends on the others influence to become fully appreciated and successful in operation, and therefore evolves such an effective display system for the control and exhibition of chemiluminescent light.

Which to this point, has to the best of my knowledge never been so diversified, thus allowing the advantageous use of a wider variety of materials and design, in turn opening new horizons for the manufacture of larger or more complex and relatively economical displays, with greater commercial appeal.

Other objects and advantages, of this invention will be obvious upon the understanding of the illustrative embodiment about to be described, or will be indicated in the appended claims, and various advantages not referred to herein will occur to one skilled in the art upon employment of the invention in practice.

A preferred embodiment of the invention has been chosen for the purpose of component optional configuration illustration and descriptions and is shown in the accompanying drawings, forming part of the specification.

BRIEF DESCRIPTION OF DRAWINGS

In the drawings, closely related figures have the same number but different suffixes.

DETAILED DESCRIPTION OF DRAWINGS

Figure 2:
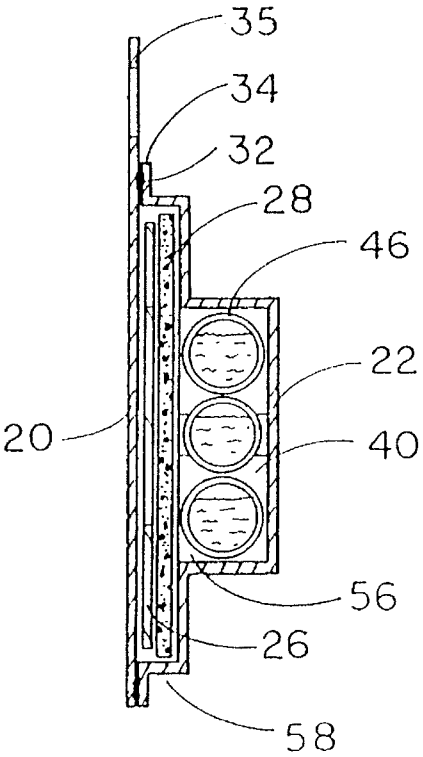
FIG. 2 a vertically sectional view through section line 2 of device 1000 showing the components, their interactive profiles, and their closely confined relationship to one another.
Figure 1:
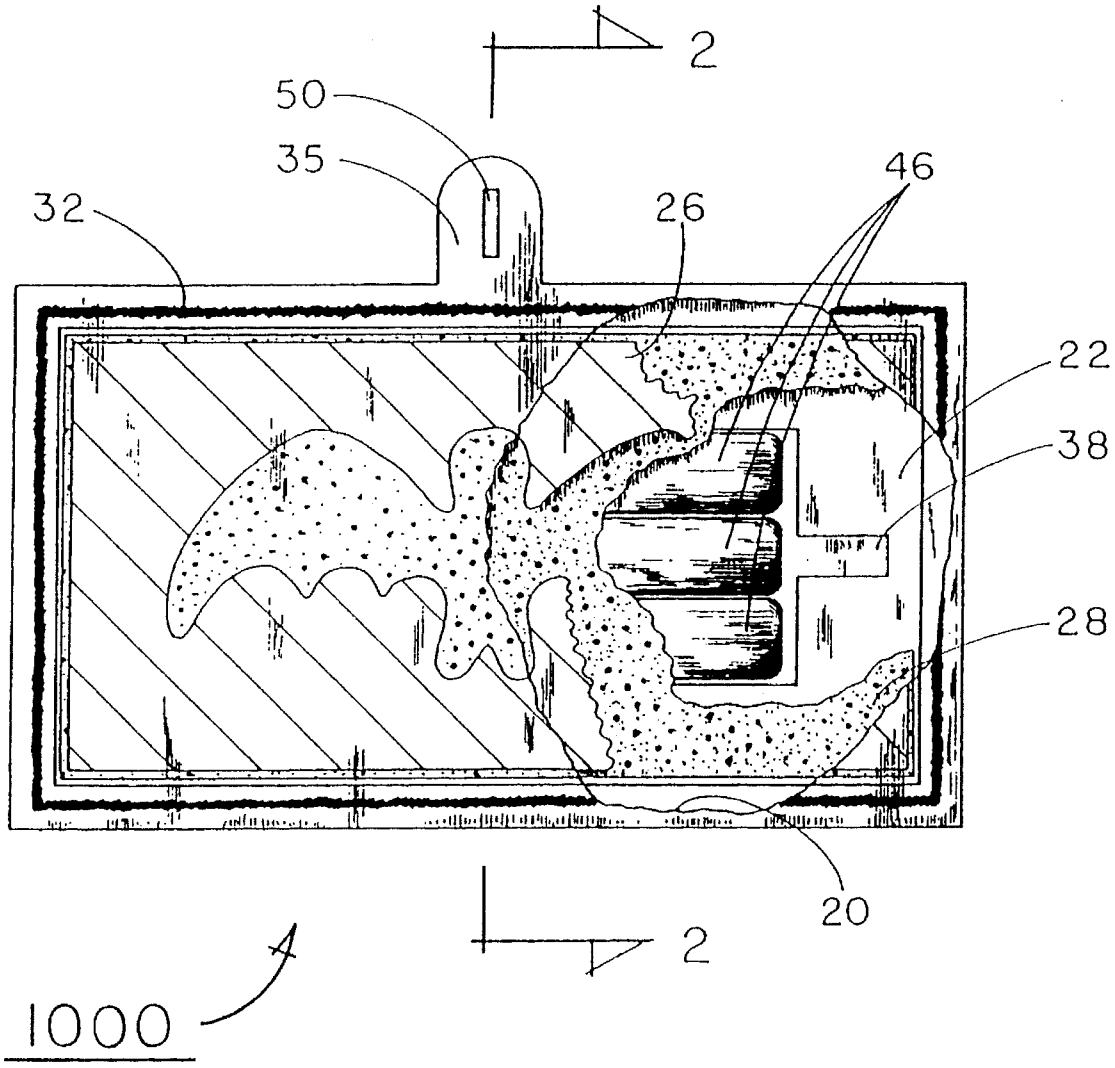
FIG. 1 illustrates a front elevational view of a primarily rectangular display device 1000 exhibiting a centrally located "Bat" shaped image, with the right hand portion of its forward facing area broken away to reveal the layered composition of its internal components, and having section line 2 vertically through its center.

The following FIGS. 1–3 illustrates a preferred embodiment of the present invention, the reference numeral 1000 generally designates the improved display device. The device is illustrated by way of example as being primarily a rectangular lighted shape projecting an independent and centrally located "Bat" shaped image. It being understood that device 1000 is an example of an assembly utilizing a series of optional systematic features and components to create a lighted display.

Other embodiments may be double sided and utilize any number or combination of these components and features assembled in any desired shape, color and configuration thereof in order to achieve the required artistic display. A further consideration is the intended option of suspending device 1000 by helium filled balloons, demonstrating its lightweight construction. In order to facilitate this form of support, device 1000 has a special flange design, and has also utilized light gauge materials, such as for example, thermoplastic type sheet in singular or composite form, of a general thickness 25 mil (0,025 inch) or below depending on required display size or rigidity.

FIG. 1 showing device 1000 having a somewhat rectangular contoured shape and where a transparent front shell 20 or wall is partially broken away at its right-hand side to first expose a colored and transparent layer of material referred to as an insert 26 whose perimeter in this case, is rectangular and incorporates within its central area a cutout "Bat" shaped image. This layer too is broken away at its right-hand side to expose another rectangular layered liquid-absorbing material which forms a front display image 28. Once again this layer too is broken away in a portion of its right-hand side to reveal a set of glass vials 46, seen intact and therefore, the device 1000 is in a "pre-activated" state, whereby the required portions and ratio of chemiluminescent chemical are still captured and isolated within said glass vials 46. Also exposed is a portion of an opaque rear shell 22 or wall, which within itself is rearwardly recessed, to mirror and accommodate the protruding profiles of the internal components. One such recess is shown as a vial chamber 40, serving as a closely confining compartment to accept said glass vials 46. Radiating away from said vial chamber 40, is another rearward recess which is referred to as a duct 38, primarily designed to convey the chemical away from the vial chamber 40. The perimeter area of said rear shell 22 closely contacts and matches the perimeter of said front shell 20 with the exception in this case, of an extended flange 35 seen further extending laterally and outwardly from the upper edge of said front shell 20 periphery and incorporating an attachment orifice 50. This matched perimeter area referred to as a flange 34 incorporates an impervious seal 32, which effectively seals the internal components within the confines of its inner boundaries.

FIG. 2 a vertically sectioned view through section line 2 of device 1000 shows the layered relationship of each component as they relate and interact with one another and showing that said front shell 20 is in close contact and in a parallel relationship to said insert 26, which itself is in close contact and parallel to said front display image 28, both component thickness closely matched to the rearward recess dimension of the inner cavity border wall 58, and therefore both components are effectively captured and supported in that area. Glass vials 46 are in close contact with a rearward portion of said front display image 28 and are confined to a mirrored rearward recessed area formed within said rear shell 22 and in turn are effectively captured and supported in that area. The areas within said rear shell 22 which are not recessed to mirror the protruding profile of said glass vials 46, remain in close contact with the exposed rearward portions of said front display image 28, which in turn is providing support for said insert 26 being supported by said front shell 20. Both said flange 34 and said extended flange 35 are shown in the lower and upper portions respectively and incorporate said impervious seal 32. It is clearly apparent that the total mass of the internal components closely matches the total volume of the void within the overall outer shell creating in effect a minimal cavity 56 device which actively bolsters in consecutive fashion, the performance and position of its internal components.

Figures 3A, 3B, 3C, 3D, 3E, 3F:
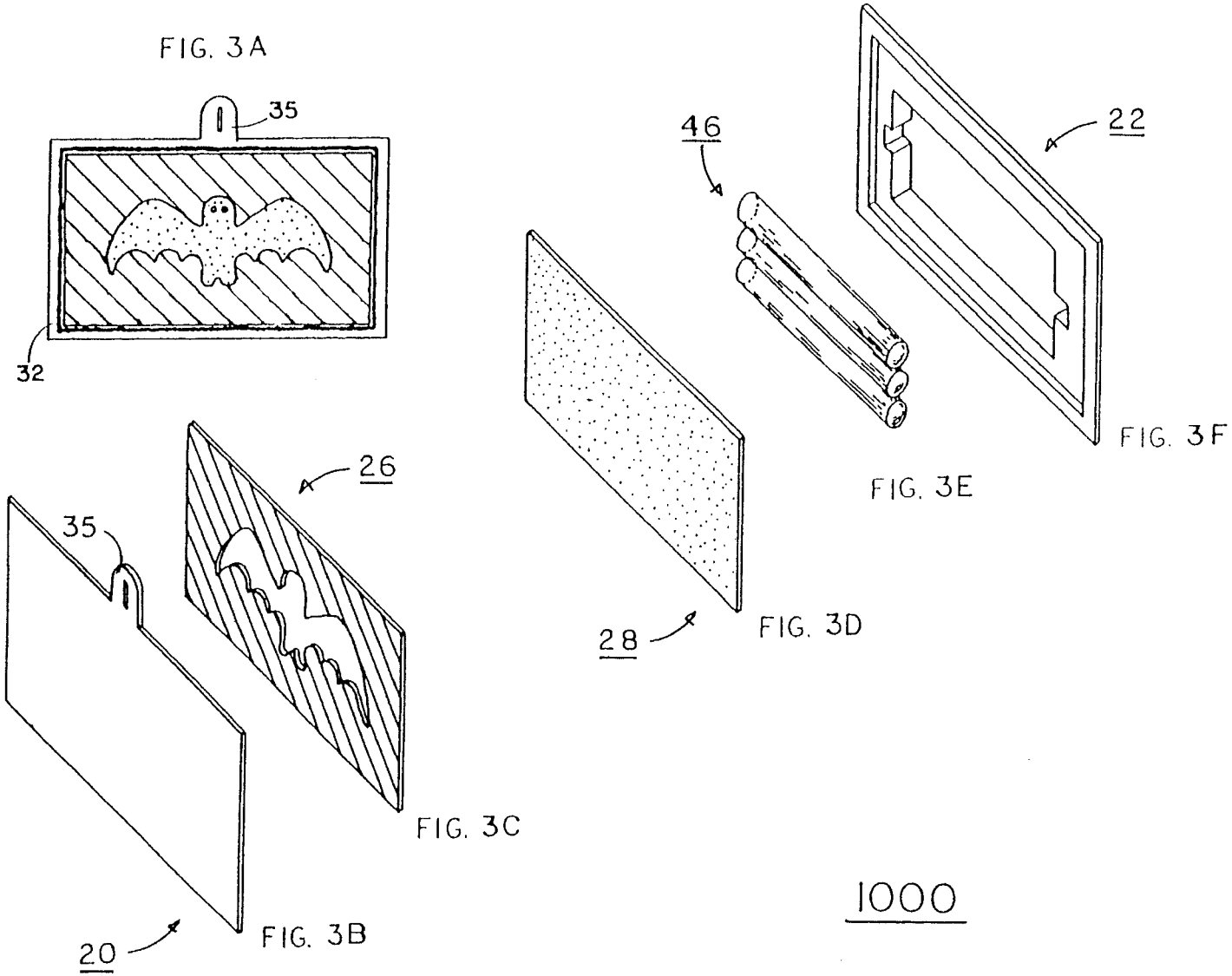
FIG. 3A illustrates a front elevational view of device 1000 where hatch lines indicate a different color or shade of light to the light emanating from the dotted central area.
FIG. 3B an exploded isometric view of the transparent front shell 20 or wall of device 1000.
FIG. 3C an exploded isometric view of the colored insert 26 layer incorporating a superimposing centrally located "Bat" shaped image independent of the primary perimeter rectangular shape of device 1000.
FIG. 3D an exploded isometric view of the primary rectangular light enhancing front display image 28 of liquid-absorbing material of device 1000.
FIG. 3E an exploded isometric view of a set of glass vials 46 isolating a proportionate ratio of pre-activated chemiluminescent chemical of device 1000.
FIG. 3F an exploded isometric view of the opaque rear shell 22 or wall of device 1000.

FIG.3A an elevational front view of device 1000 showing the device as it would appear in an activated state with the aid of hatch lines and dots representing the visual variation in light resulting from each components intended influence over others and over the originating chemiluminescent light.

FIG. 3B an exploded isometric view of the transparent and colorless said front shell 20 of device 1000 which in this case is simply a sheet like layer of a thermoplastic resin having a rectangular shaped perimeter with said extended flange 35 protruding from its peripheral upper edge both laterally and outwardly, and centered on said front shell 20 upper edge. In this case said extended flange 35 is a short extended area protruding enough to accept an attachment orifice 50.

FIG. 3C an exploded isometric view of, in the case of device 1000, a colored yet transparent sheet like layer of thermoplastic resin use as a light control member and designed as said insert 26 which is rectangular in peripheral shape incorporating a central knock-out area, shaped so that it superimposes a "Bat" like image onto the surface of the next layered material.

FIG. 3D an exploded isometric view of the primary or peripheral rectangular shaped image of device 1000 being a liquid-absorbing material layer designed as said front display image 28 and from which the originating light will be projected.

FIG. 3E an exploded isometric view of a set of three said glass vials 46, each as an elongated glass tube sealed at both ends and designed to contain and isolate a proportionate component of the chemiluminescent system, in a per-activated state awaiting activation by disintegration within the confines of device 1000.

FIG. 3F an exploded isometric view of, in the case of device 1000, an opaque said rear shell 22 incorporating all the necessary component controlling features required within device 1000 where this components sheet like layer of thermoplastic resin is of a rectangular contour and shows said flange 34 formed throughout its perimeter, and where at the inner boundary of said flange 34, this component is outwardly recessed slightly to accommodate the thickness of the intended layers to be located in this rectangular compartment of the shell wall. This recessed wall is further outwardly recessed in a subordinate and centralized area to create a smaller rectangular area or compartment designed as said vial chamber 40 to accommodate the thickness and profile of the chemical isolating components. There also exist on either end of this compartment, narrower channel like extensions of this same recess which radiate away from the compartments shorter ends toward said flange 34 and are designed said ducts 38 to disperse released chemical.

Figures 4A, 4B, 4C, 4D, 4E, 4F:
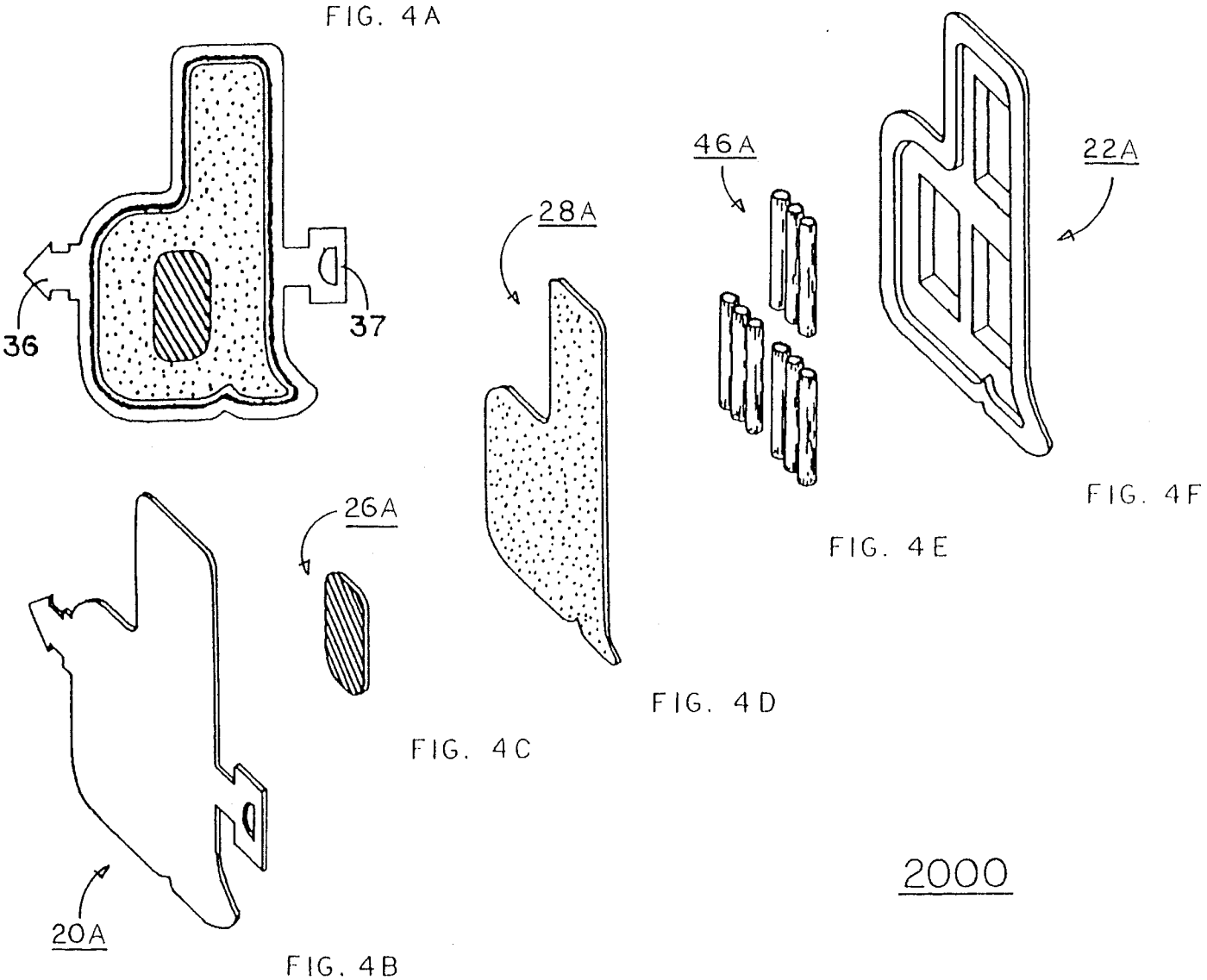
FIG. 4A illustrates a front elevational view of device 200 where hatch lines indicate a light suppressed area within the dotted area indicating the emanating light.
FIG. 4B an exploded isometric view of the transparent front shell 20A or wall of device 2000.
FIG. 4C an exploded isometric view of the light negating insert 26A layer superimposing the "Knock-out" image independent of the primary perimeter shape of device 2000.
FIG. 4D an exploded isometric view of the primary light enhancing front display image 28A of liquid-absorbing material of device 2000.
FIG.4E an exploded isometric view of three sets of glass vial 46A, each set isolating a proportionate ratio of pre-activated chemiluminescent chemical of device 2000.
FIG. 4F an exploded isometric view of the opaque rear shell 22A or wall of device 2000.

FIG. 4A an elevational front view of device 2000 showing the device as it would appear in an activated state with the aid of dots and hatch lines representing the visual variation in light resulting from each components intended influence over others and over the originating chemiluminescent light.

FIG. 4B an exploded isometric view of the transparent and colorless front shell 20A of device 2000, which in this case is simply a sheet like layer of thermoplastic resin having a perimeter shaped as a letter "d" and exhibiting separate the extended flange 36 & 37 areas on either of its vertical sides. The extended flange 56 on its right side is shaped somewhat like an arrow designed to easily be inserted into a mating orifice as is shown on said extended flange 37 on device 2000 left side.

FIG. 4C an exploded isometric view of, in the case of device 2000, an opaque sheet like layer of thermoplastic resin designed as an insert 26A of rectangular shape with rounded corners designed so that it negates any light emanating from the surface area of the material layer directly behind itself.

FIG. 4D an exploded isometric view of the front display image 28A which is the primary shape or contour of device 2000, and is a layer of liquid-absorbing material.

FIG. 4E an exploded isometric view of three sets of three glass vials 46A, each vial within the set is an elongated glass tube sealed at both ends an designed to contain and isolate a proportionate component of the chemiluminescent chemical system, in a pre-activated state awaiting activation by disintegration within the confines of its compartment within device 2000.

FIG. 4F an exploded view of in the case of device 2000, an opaque rear shell 22A which is a sheet like layer whose perimeter or outer contour closely matches the outer contour of said front shell 20A, with the exception of any extended flange areas. A flange is shown throughout said rear shell 22A periphery and then within the inner boundary of the flange area is formed an outwardly recessed area to create a slightly lower level or compartment which is recessed enough to coincide with the thickness of the components to be located in that area. This lower area is further outwardly recessed to create three subordinate yet independent rectangular indentations or cavities which are designed as vial chambers and themselves do not greatly exceed the outward profile or thickness of the components to be house there.

Figure 5:
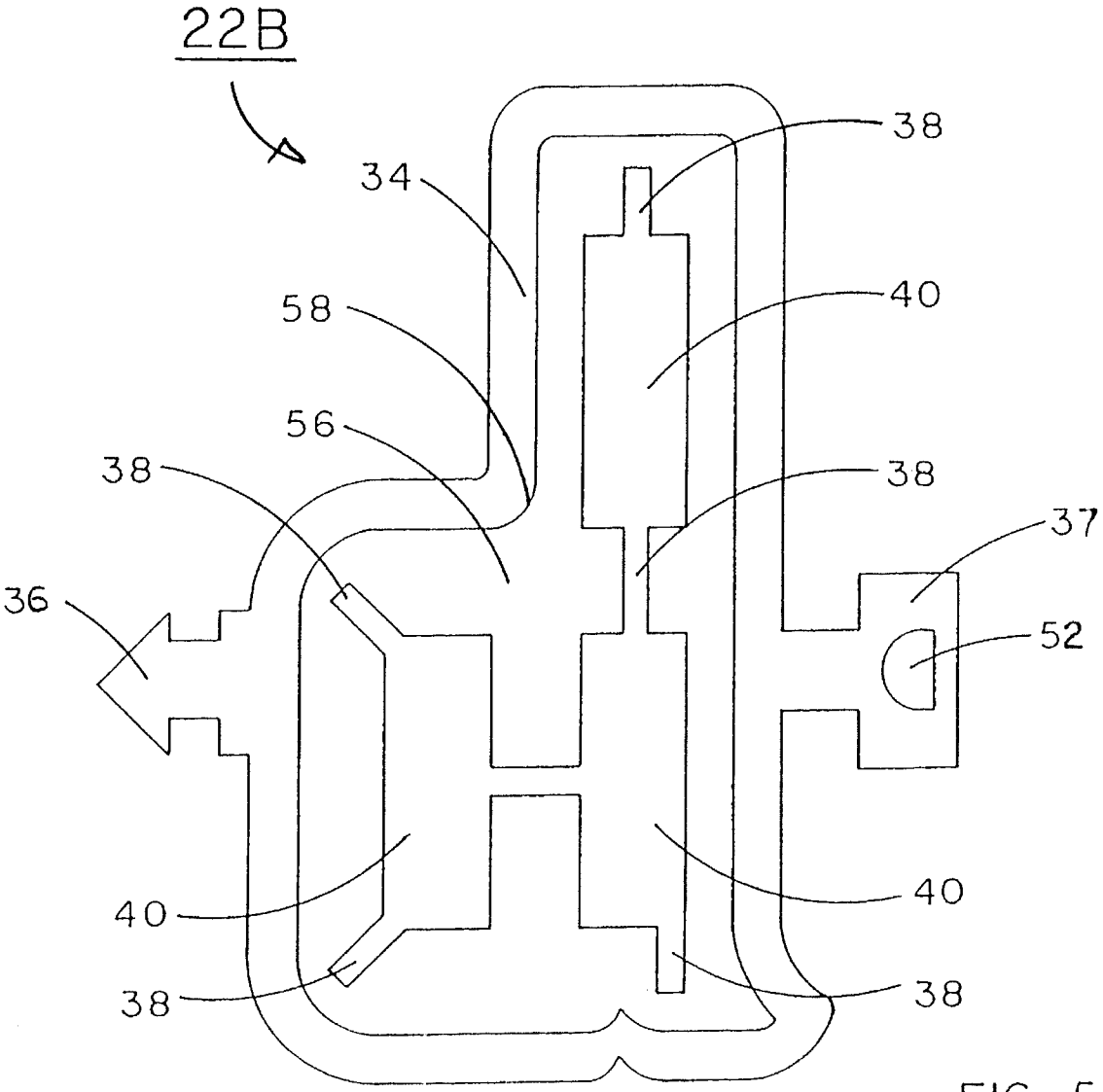
FIG.5 an elevational view and example of a modified rear shell 22B or wall incorporating ducts within device 2000.

FIG. 5 a front elevation of a modified rear shell 22B or wall of device 2000 which shows an optional modification to the device 2000 to incorporate features used in device 1000 where ducts 38 which are outward recesses have been included and are shown to intersect and interconnect with all three outwardly recessed vial chambers 40, and are shown to radiate away from the vial chambers 40 and toward the flange 34. Other features such as extended flange 36 & 37, attachment orifice 52, inner cavity border wall 58, and minimal inner cavity 56 are included.

Further description of the Preferred Embodiments of the invention, including their significant operation This invention is directed at a device for the control and display of chemiluminescent light, of which is described a basic device comprising in sequential relationship.

a) Said front shell 20 formed as a wall or sheet-like layer of a thermoplastic resin, which is shaped in the case of device 1000, as a rectangle having a small outward protruding area or extension on the upper elongated edge of the sheet. This extension is a surface through which a orifice has been made in order to facilitate attachment, merging and interlocking devices such as string, cords, pins, nails . . . etc. The extensively flat structure of this wall is significant in the case of device 1000, because it mirrors closely the flat surface profile of the internal component in direct contact with this walls inner surface, thereby providing direct support for that layer and any other subsequent layers thereafter. A small outlining area of the rectangular periphery of device 1000 is utilized as said flange 34 which is to be matched in a parallel overlying or layered relationship ith a second wall or said rear shell 22 to be described later, this said flange 34 area will become the substrate which will receive said impervious seal 32. In other embodiments the periphery of this wall does not necessarily have-to match or directly correspond with that of the second wall and visa versa, in fact there may be times that a single front wall may accept several rear walls.

b) Said insert 26 which is a light control layer projecting a rectangular outline having a "Bat" image knocked out from its center area and placed immediately behind and in parallel or layered relationship to the inner surface of said front shell 20. Said insert 26 is designed with a primary function in device 1000 to be a layered light controlling component that physically controls the visual effects of the chemiluminescent light whose origin will be discussed later, and which is emitted from behind its own inner surface. In the case of device 1000, this light passes through said insert 26, then continues outward as its passes through said front shell 20. The effect is an alteration in visual light characteristic of the light emanating from the area directly under the influence of said insert 26. As shown in device 1000 to cause a color shift in the area directly covered by said insert 26 due to the use of a dissimilar color between the originating light and said insert 26 material. In other devices depending on the transparency or color, said insert 26 may be used to control suppression, negation or even enhancement of this light. In other embodiments it may also be necessary to utilize numerous said inserts 26 of varying performance through changes in material, color, shape and shade, placed in front of, or imparted on, or combined with each other to achieve the desired light contrasts. furthermore, in other embodiments there may be no desire to utilize the properties of said insert 26 and in-turn may be omitted for the device without adverse effect. The forward surface of said insert 26 depends upon its close proximity and layered relationship to said front shell 20 for support and positioning, however it is equally as important for its own inner surface to be in close relationship with other internal components.

c) A front display image 28 which in the case of device 1000, is a rectangular liquid-absorbing layer, formed from a sheet-like light enhancing porous absorbent material which is readily saturated or impregnated by the chemiluminescent chemical to be discussed later. Once saturated, said front display image 28 projects outward, its own image in the form of light. In the case of device 1000, this lighted image or shape then travels forward through said insert 26 subsequently becoming defused or altered in those areas control led by said insert 26, and continuing outward passing through said front shell 20, hence presenting a lighted display. However in other embodiments said inserts 26 may also be imparted on, or combined with said front display image 28 itself. Importantly, the forward surface of said front display image 28 is contributing to the support of the inner surface of said insert 26 due to its close proximity and parallel layered relationship, of which said insert 26 itself is experiencing simultaneous forward support from the inner surface of said front shell 20. However, it is yet again significant that said front display image 28 provided features relating to support and positioning in areas of its inner surface by perimetral portions of further device components to be discussed.

d) A glass vial 46 set each individual vail contains and isolates an opposite part and portion of the liquid two part chemiluminescent system which when mixed, becomes activated and subsequently produces visible light. In the case of device 1000 the required proportionate mix is 2:1 and hence the use of a three vial set. This proportionate set is located in close contact with the inner surface of said front display image 28 and simultaneously confined in close proximity to one another, in a rearwardly recessed area or compartment known as a vial chamber 40 provided in the final component of this assembly and to be discussed later. Said vial chamber 40 itself is in close contact with the rearward surface of said glass vial 46.

e) A rear shell 22 formed as a wall or profiled layer of a thermoplastic resin, whose contour in the case of device 1000, is a rectangle, also having rearwardly recessed areas formed as a plurality of compartments onto its inner facing surface within the boundaries of that rectangular periphery. The first compartment is created by the perpendicular or rearward direction of the inner cavity border wall 58 which is adjusted to closely match the total thickness of said insert 26 and said front display image 28 together. The next compartment is a further rearward and perpendicular recess in a subordinate surface area of the first recess creating two essential features, one of which is said vial chamber 40, being rectangular in shape and closely matches not only the thickness or depth of said glass vial 46 but also the length and width displacement created by the three vial set. The other essential feature is known as ducts 38, these are similar in rearward or recessed depth to that of said vial chamber 40 but are effectively narrow channels which intersect at either end of said vial chamber 40 and then extend for a distance toward the outer edge of said rear shell 22 without intersecting said flange 34. The profiled structure of said rear shell 22 is significant in the case of device 1000, because it mirrors the surface profiles of the internal components exposed to its inner surface, thereby controlling the position of those components, and whenever possible maintaining as little distance as possible between the inner surface of said rear shell 22 and the inner surface of said front shell 20, either one separated only by the mass of the components housed between them, thus effectively creating a minimal inner cavity 56. Said minimal inner cavity 56 is considered such, because the aggregate mass of all internal components closely matches the total volume of void within the confines of said front shell 20 and rear shell 22, and that the lateral expanse of the subordinate compartments are substantially less than the lateral expanse of the layered material compartment. Another feature is the outlining area of the rectangular periphery of said rear shell 22, which is utilized as said flange 34, and is to be mated in a parallel overlying relationship with a similar area found on said front shell 20, both then become the common substrate for said impervious seal 32. In other embodiments the arrangement shape and configuration of this component may be changed in order to accomodate the profiles or displacement of those internal components best suited to the performance of that particular embodiment.

Considering the instant invention whose major components are presented above within said device 1000, and recognizing that this is a display system whose varying combination of internal layered components are manipulated to control the chemiluminescent light for desired effect, and by creating mirrored recesses within the device itself for those internal components, in order that they interact in a controlled and somewhat predictable manner, result in a superior chemiluminescent light display.

The instant inventions display system overcomes the pitfalls of previous single recess or vast cavity designs, which exhibited on relationship between internal component mass and internal void volume, resulting in devices whose internal components were much smaller than the void they were confined too . Therefore these devices were lacking in the ability to truly overcome collapse and migration of important internal light presenting components.

The added value of the instant inventions superior technique, is that the inherent benefit of such control allows the manufacture of larger devices, subsequently opening new avenues far beyond novelty items and into the commercial field of advertising.

In order to avoid repetition and for purposes of abbreviation the term "chemically compatible" herein after is to be comprehended as, and brought to bear, that all components are reasonably compatible with one another, in so far as during their required operation such components be resistant to unreasonable degradation by the chemiluminescent chemical without unfavorably affecting the chemicals required performance.

Further noting that the favored chemiluminescent material is a liquid capable of providing chemiluminescent light for a finite period. The precise chemical or physical nature of the chemiluminescent composition is not critical to the definition and scope of this invention. However, the light which is emitted by the material is preferred to be in the visible range and the material itself be "chemically compatible" within reason with materials utilized in the present invention.

Similarly the favored materials used in the creation of the present invention are materials which are capable of performing their desired function adequately so that they may interact favorably with one another to produce an illuminated display.

The precise method of chemical isolation used is not critical to the definition and scope of this invention. However, the method used is preferred to be "chemically compatible" within reason with the chemiluminescent chemical, and that the materials used are capable of performing the desired task of containment and isolation until desired that the contained chemical be readily released for mixing. The precise chemical or physical nature of the materials used are not critical to the definition and scope of this invention. However, the material used is preferred to be "chemically compatible" within reason with the chemiluminescent chemical, and that the materials are capable of performing the desired task set forth by this inventions characteristics as a display system of interacting recesses, compartments, cavities, or the subordinates thereof, layers and formed surfaces or vessels.

Regarding said front shell 20 (FIG. 3B) and said rear shell 22 (FIG. 3F) both are "chemically compatible" within device 1000 (FIG. 1) being transparent to translucent and opaque respectively, and typically of a thermoplastic resin sheet whose thickness range will generally not exceed 25 mils (0.025 inch) and may be produced from a polyolefin such as but not limited to, polyethylene, rigid vinyl, or the like.

In other embodiments said rear shell 22 for example may be formed of materials of a composite nature, such as a composite sheet having an outer layer of a metallic foil permanently joined by laminating on its underside or inner facing layer to a flexible thermoplastic resin or polyolefin type layer. Then being formed into a side or shell by a compression method producing an opaque shell of a single sided viewed device. Not only will this shell possess all of the attributes of a thermoformed shell which is capable of being formed into shape and sealed to its opposing shell, but also exhibits an added internal component restricting benefit, which is that when this composite type shell which is sealed to an opposing transparent shell, is then depressed in the said vial chamber 40 (FIG. 2) areas, in order to crush said glass vials 46 for activation, these areas will remain depressed in those areas due to the nature of the memory retaining metallic foil layer. The advantageous result of this performance is that the void normally left behind once the said glass vials 46 disintegrate, is now removed and therefore provides added rearward support to the other internal components still remaining.

The foremost consideration for the selection of shell material, is that the material is capable of being formed into its required shape and able to withstand the intended operational forces without violating the devices integrity as a liquid container, yet remain "chemically compatible".

Forming of said front shell 20 or said rear shell 22 in the case of device 1000 may be achieved through die cutting a raw material sheet once desired features have been thermoformed thereon, but may also be achieved in other embodiments by pressure forming methods such as compression molding, or even injection molding.

Regarding said rear shell 22 in the case of device 1000 having thermoformed therein multiple recesses, compartments, cavities or receptacle-like features, which once sealed together with said front shell 20, produce a housing with five (5) critical criteria contributing to device performance, and essential for the successful control of internal components and a major influence in the performance of said device 1000, thereby making possible greater diversity of shape, dimension, activation, and arrangement. The five (5) criteria are as follows:

i) Provide a shell utilizing minimal inner cavity design, by defining a first rearward recess or main compartment for confining layered components, then incorporating further rearward recesses as subordinates to the first for confining and controlling the chemical itself and its isolating receptacles. These rearward recesses essentially mirror the profiles or displacement of the internally housed components, and have an aggregate void dimension which is without excessive volume in relation to the housed internal components. Resulting in effect to sandwich internal components between either shells inner surfaces and keeping in check those internal components for presentation as an artistic display.

ii) Provide a shell utilizing a specific recess or compartment, for the location and restraint of layered internal materials. Thereby providing simultaneous forward and rearward support for those layered material configurations.

iii) Provide a shell utilizing specifically located subordinate recesses or compartments, as consolidating type receptacles for the location of chemical isolating devices. Resulting in a confined area for these devices to be violated or destructed in order to release their contents to become relatively instantaneously mixed, initially in these confines and then dispersed to become absorbed. Thereby achieving controlled points of release for even and predictable absorption for superior activation and operation.

iv) Provide a shell utilizing specifically located and directional subordinate recesses or compartments, intersecting or interconnecting other larger compartments and radiating toward the inner boundaries of the device flange. Resulting in a conveyance feature for assisting the transfer of released chemical from within those larger compartments and toward the extremities of that particular device.

v) Provide a shell utilizing an area extending beyond the sealed perimeter of the device, without interrupting the integrity of that seal, which provides a foundation for the merging and interconnecting of that particular device with other devices, or provide a substrate for support and suspension, thereby achieving a protruding surface which may become common by bonding, tying, adhering, forming, extruding, pinning, or any other method to achieve this end. Furthermore the use of this area for display support or exhibition now liberates the second side of the device only then is it possible to have the option of producing a truly functional double sided display.

In explanation and matching of Device 1000 component features to the five (5) listed critical criteria available for the design of Device 1000 is as follows:

Criteria i & ii are evident in device 1000 where said minimal inner cavity 56 (FIG. 2) provides internal component restriction or confinement, when said front shell 20 and rear shell 22 are assembled and sealed in juxtaposed relationship, in this case by said impervious seal 32 being imparted throughout the matching perimeters of both said flanges 34 to ensure overall integrity of said minimal inner cavity 56. Said minimal inner cavity 56 maintains its minimal clearance throughout, by defining at least two successive rearward recesses or compartments each of which accept within a close tolerance, only the bulk or mass of the component housed in that area, and that the lateral expanse of the second or subordinate compartment is substantially less than the lateral expance of the first compartment. This clearance dimension is controlled upon the formation of said rear shell 22 by increasing or decreasing the perpendicular dimension of an inner cavity border wall 58 (FIG. 2) accordingly. The added result of this said minimal inner cavity 56 design, is that the surface tension is greatly improved by each component successively contacts the next component throughout Device 1000 for better handling during any specialized manufacture requirements such as external display image.

Criteria iii is evident in device 1000 where said vial chamber 40 (FIG. 2 & 5) is a rearward recess in a subordinate area of the first rearward recess, forming a somewhat consolidating or confining area for a plurality or set of said glass vials 46 (FIG. 3E). This method is important to ensure not only that this required proportion of pre-activated chemical remains in close proximity to one another at all times, but also that, when these proportions are released by externally depressing the surface area of said vial chamber 40 to crush said glass vials 46, that these proportions are then released in rather close proximity to one another for improved mixing and hence improved activation of light.

Criteria iv is evident in device 1000 where said ducts 38 (FIG. 2 & 5) are also rearward recesses in subordinate areas of the first rearward recess, and form a plurality of channels which intersect said vial chamber 40 at either end and then radiate away from that area toward an extremity area. This is effectively a conveyance network, whose purpose is to allow the collecting and travel of chemical from the point of release toward an extremity, in order to facilitate improved chemical dispersion.

Criteria v is evident in device 1000 where said extended flange 35 (FIG. 1 & 2) is a protruding feature generally extending laterally outward from the periphery and upper edge of said flange 34 and said impervious seal 32, and where said flange 34 itself is the foundation for said extended flange 35. Most importantly said extended flange 35 is provided as a medium which may accept an orifice or other integral form to become common, merge or interlock with another device or method of suspension or support, which may be achieved by extruding, bonding, sealing, forming, tying, pinning or any other method which will cause the mingling of devices.

Regarding said inserts 26 (FIG. 2 & 3C) being "chemically compatible" within Device 1000 formed of a transparent thermoplastic resin layer having die cut or knocked out from its center area the image of a "Bat" and seen as the layer immediately behind said front shell 20, and directly in front of said front display image 28. This component is a light controlling member of different color to that of the chemiluminescent chemical light, effectively altering the visual color of the originating light over which it is superimposed and not affecting the color of the light passing unaffected through its knocked out center area. The result is a two color visual effect. Also said insert 26 is relying on its position between the aforementioned components for its support and effective presentation.

However in other embodiment said inserts 26 may be of any "chemically compatible" material, layered singularly or in plurality, positioned in front of, attached to, imparted on or incorporated in, any light enhancing material utilized to create the desired visual effect of light contracts. Said inserts 26 also having two (2) critical criteria governing their performance for successful control of light. The two (2) critical criteria are as follows:

i) Provide a light "altering" material allowing the passage of originating light directly under its influence to appear altered in visual color and shade upon passage thereof and therefore appear altered or different to other unaffected areas.

ii) Provide a light "contrasting" material by engulfing or blocking the originating light within itself or behind itself to thereby appear indiscernible from its originating state and therefore of a stark contrast to other unaffected areas.

In explanation and matching of these critical criteria to that insert 26 used in device 1000 as follows:

Criteria i is evident in Device 1000 where insert 26 (FIG. 2 & 3C) is a layer of material similar to that of said front shell 20 however is of a color opposite or different to the originating light and therefore will achieve a light altering influence over that light passing through it. In other embodiments this light altering effect may also be achieved by a layer of inert dye directly over or in contact with any area of the absorbent material.

Criteria ii) is not utilized in device 1000, however for the purpose of explanation, if in another embodiment the insert material were to be formed of a porous absorbent material having within itself or imparted upon itself a dark and non-reflecting color, the resulting effect would be to suppress, negate or block that light directly under its influence in-turn creating a stark contrasting effect to that of other unaffected areas.

Regarding said front display image 28 (FIG. 2 & 3D) being "chemically compatible" within device 1000, being a porous liquid-absorbing material of a light enhancing characteristic due to the ability of its mass to readily reflect the absorbed lighted chemical. Said front display image 28 is seen as a layered material immediately behind said inserts 26 and directly in front of, in some areas said glass vials 46 and the remaining area said rear shell 22. This component is a porous absorbent material readily saturated by the chemiluminescent chemical isolated within said glass vials 46 and this material is one such as a virgin non-woven material being 100% acrylic felt, available from "the Felters Co" of MA and generally of a thickness 0.18 inch or below. However in other embodiments other unique design porous absorbent materials such as composites like a high-loft, non-woven/air laid cellulose sheet available from "Oliver Products", of MI, or even other porous absorbent such as pulp or fiber paper sheet with blotting capability available from "James River Corp" of Pa.

Furthermore referring to materials listed in U.S. Pat. No. 4,814,949 to Elliott, under table 1, which portrays limitations for what Elliott considers an ideal material within the teachings and specifications of Elliotts device. Contrarily, a majority of those materials listed by Elliott may be successfully employed within the instant invention due to the five (5) critical criteria used in the shell design, furthermore the instant invention may utilize each materials unique characteristic to its advantage, because the instant invention has the necessary features to overcome or compensate for any material weak point unlike Elliott, and so can benefit from the strong point of the material if that characteristic is so desired to achieve the required artistic display.

Therefore, device 1000 or any other embodiment of the present invention requires that the porous absorbent material reasonably perform to that function for which it was selected, whether it be that high light output, negation, suppression or absorbency of light is the function of choice. Issues of rigidity are of no major concern for the instant invention because the device shell provides the support.

Unlike the limitations for absorbent selection set in the table provided by Elliott just to overcome collapse while providing suitable light emitting properties before an acceptable device may be produced, hence, Elliott is admitting to limited application and therefore can not be considered or compared to the instant invention as a system for light control and artistic display. Regarding said glass vials 46 (FIG. 2 & 3E) formed of a frangible glass tube, heat sealed at both ends, preferably of type N51A glass available from "Becton Dickinson" of Mo. The function of said glass vials 46 within said device 1000, is to contain and isolate therein one opposite part of the two part chemiluminescent chemical system until required for activation. It is to be noted that in the case of said device 1000 the selected chemical proportion is 2:1 and therefore, one said glass vial 46 is accompanied by two similar said glass vial 46 containing the opposite proportionate part of the chemiluminescent compound thereby completing the chemiluminescent system required to produce the chemiluminescent light. Said glass vials 46 are themselves in the case of said device 1000 contained in specific areas of said rear shell 22 (FIG. 1 & 2).

Said glass vial 46 must generally be of the frangible range whereby, crushing by hand may occur by a exerting reasonable pressure upon the external surface of said vial chambers 40 bearing down on and deflecting said glass vials 46 surface, in so doing disintegrating those proportionate groups of said glass vials 46 within said vial chambers 40 and releasing their contents to become combined with those released from their abutting similar said glass vials 46 containing the opposite chemical part. Relatively instantaneous mixing initially occurs in the area of said vial chambers 40 yet further mixing and dispersion occurs as the released chemical travels within said ducts 38 becoming deposited in numerous remote areas across the surface of said front display image 28, the total quantity of chemical is such that substantial saturation of absorbent material within device 1000 occurs.

However in other embodiments, other frangible materials or methods of chemical containment and isolation may be adapted and employed such as for example the fragile glass capsule within a flexible container as disclosed in U.S. Pat. No. 2,681,168 or any other effective method of containment for that matter.

The precise method of chemical containment and isolation is not critical to the scope of the instant invention, as long as effective containment, isolation and release are achieved, this is all that is require for the instant invention to then control the points of release and dispersion during such an event, by suitably adapted providing locations such as said vail chambers 40 and said ducts 38, which in turn ensure a superior dispersion and distribution of activated chemiluminescent chemical. Regarding device 2000 (FIG. 4A . . . 4F) intended to simplify and convey the concept of design variations made possible utilizing the display combinations of components and features provided by the instant inventions component system. Moreover to present in an imaginative fashion, the light control afforded by the two (2) critical criteria relating to said inserts 26, yet without overlooking the five (5) critical criteria applied to said front shell 2, or rear shell 22, which is the essence for the successful production of effective artistic display devices of this kind. In so doing, illustrating how the instant invention liberates visual and physical dimensional boundaries experienced by other forms of chemiluminescent devices utilizing a vast cavity design, thereby presenting the following examples created as follows:

EXAMPLE 1

A single display device (FIG. 4A) shown in elevational view shaped as the letter "d", intended to appear once activated as the outline or framework of the letter being a yellow light with the center area or hole of the letter appear as a green light, thereby projecting a two color image using a single yellow color chemical, in this case, the result is yellow and green and is described as follows:

Front shell (FIG. 4B) may be formed from a sheet of colorless yet transparent thermoplastic resin about 0,02" thick, which therefore will not influence the color of the light in any way but will allow the light to pass through easily. The perimeter flange area matches closely to the intended mating area of the ream shell (FIG. 4F) with the exception of the two extended flange areas on the right and left sides. Once imperviously sealed together the two create a device package or comportment suitable to control the position of the internal components. Rear shell (FIG. 4F) may be formed from a sheet of black and opaque thermoplastic resin about 0,02" thick, which therefore will not allow light to penetrate in this rearward direction. Its flange area closely matches and will mate in a parallel and flush relationship to the perimeter area of the front shell (FIG. 4B). Its inner area exhibits the characteristic of a minimal cavity as there in a first recess within the boundaries of the flange area, and then in three separate central subordinate areas there are further rearward recesses creating compartments for vial sets. These compartments await layered assembly of internal components.

Insert (FIG. 4C) is formed of dark blue tinted yet translucent thermoplastic resin sheet about 0.01" thick which is overlaid and fixed into position upon the porous material of the front display image (FIG. 4D) by a "chemically compatible" method such as an instant or silicone glue available from "Devcon Corp" of Ill. However any fixing, bonding, sealing or taping method may be used as long as it is "chemically compatible". This component will allow the passage of light, however because it is of a different color to the spectrum of yellow light generated by the chemical released from the glass vials (FIG. 4E), it will alter the visual color of that light as it emanates outwardly from the front shell. Porous absorbent material (FIG. 4D) formed of white light enhancing 100% acrylic felt about 0.05" thick engrossing entire inner cavity profile or first rearward recess in the rear shell (FIG. 4F). Because of its light and therefore reflective mass, it will readily absorb the released chemical and then project that light in an outward direction to be controlled or effected by each component which it contacts.

Glass vials (FIG. 4E) each isolate the chemiluminescent component proportions from one another until released by crushing the vials. The chemiluminescent light provided in this case is producing yellow light. The complete and proportionate sets of vials are evenly distributed into three central areas or compartments within the rear shell (FIG. 4F) so that they may remain in those areas awaiting release and mixing, whereupon their strategic location assures instantaneous and even chemical distribution for absorption into front display image (FIG. 4D).

Device 2000 (FIG. 4A) is activated by applying pressure externally and directly onto the vial chamber areas, which ruptures the glass vials to release the chemiluminescent chemical for mixing to create a yellow light. The chemical dissipates throughout their respective components and features of the device, in so doing presents Device 2000 as a lighted image, where the framework of the letter is a yellow light and because the influence of dark blue material in the letters center or hole area, the light in that area will appear green.

EXAMPLE 2

Same as example 1 except for the following changes: Insert (FIG. 4C) is formed of a black absorbent paper pulp sheet, rated at about 100 lb thickness overlaid and in this case may be stapled into position upon the porous absorbent material. The glass vials (FIG. 4E) contain a chemiluminescent composition designed to produce a light in the blue spectrum. The resulting single color blue display is described as follows:

Device 2000 after activation presents a lighted image where the framework of the letter is a blue light and because of the influence of the absorbent black material in the letters center area, which effectively absorbs chemical into itself, and because of the materials dark and non reflective nature, it will suppress or negate the light under its influence and thereby appear as a stark and contracting area without light.

EXAMPLE 3

Same as example 1 except the following changes: Insert (FIG. 4C) is in effect a thin layer of inert dye such as pink paint which is "chemically compatible", applied directly onto the surface of the porous absorbent material. The glass vials (FIG. 4E) contain a chemiluminescent composition designed to produce light in the white spectrum. Thereby projecting a two color image using a single white color chemical in this case, the result is white and pink, and is described as follows:

Device 2000 after activation presents a lighted image where the framework of the letter is a white light and because it is influenced only by enhancing the pink color through which it passes, the center area of the letter will appear pink.

Accordingly the reader will understand that there are unforseen advantages in the component operation in said device 1000 and Device 2000 and the instant invention, which instead of just being a chemiluminescent container, it is rather a device whose unique minimal cavity design affords the use of a system of components to achieve an illuminated artistic display.

The prolific effect in overcoming the potential for collapse of the layered materials, in a chemiluminescent device such as provided by said device 1000 and the instant invention, has produced many options of configuration and display, by providing areas within all components to experience simultaneous forward and rearward support, hence a superior device is achieved.

This prolific effect is possible because the layered components position and shape is now not easily violated and therefore, it is possible to place light altering and contrasting elements without fear of them becoming lost or distorted with the deformed or collapsed absorbent. These light controlling elements are necessary in many cases, to provide the flexibility of light control in order to produce a special visual effect as required within a single device.

Furthermore when considering the manufacturing aspect with relation to costs and material selection, the instant invention has to a considerable extent overcome absorbent collapse, and therefore has created an advantage which allows not only the use of a wider range of absorbent materials, but also thinner materials can now be used in larger displays. Of the many positive effects of being able to use thinner absorbent material, not only is the device lighter because of lower absorbent bulk, but also requires less chemiluminescent chemical to saturate the absorbent area, which further contributes to an even lighter device. But ultimately, lower material and chemical levels translate to lower and more competitive pricing.

Unfortunately vast cavity designs of prior art, rely on the absorbent material to depend on itself for rigidity across its unsupported expanse, which then relies heavily on the absorbent thickness to increase as the outer limits of expance increase, which in turn requires more chemical for total saturation, in turn driving up costs for manufacture.

Another unforseen advantage addressed by said device 1000 and the instant invention, and perhaps unappreciated by others, is the advantage of strict location of chemical components prior to activation, not only does the device become easier to activate, but also this teaching affords the design of larger devices that are ensured repetitively predictable activation because the chemical components are allotted to certain predetermined recessed areas, and will remain there until required for a controlled point of release type activation, which ultimately produces a more satisfactory even dispersion and distribution of activated chemical.

Yet another advantage within said device 1000 and the instant invention is that, by being able to selectively control the amount of light emitted from a particular area of absorbent material, greater and more effective image detail can be achieved, because light is limited ta its source, which will provide superior contrast definition than that which may occur when attempting to control vast and superfluous amounts of light after it is released, which illuminates adjacent areas that may be adversely affected by such.

There is an added bonus that is experienced in said device 1000 and the instant invention when utilizing not only the transparency or reflectiveness of a material to control light contrast, but to also by altering the materials color to one different to that of the light which is passed through or surrounded by that material, it then becomes refracted from its originating color to a visibly different color. This feature enhances creative and effective replication of distinctive images.

Another unforseen advantage of an assembly such as said device 1000 and the instant invention, is that once such teachings of device recess and layer design is incorporated into display, there is an inherent surface tension caused by these components being assembled in this restricted and confined manner that becomes particularly suited to sustaining the deflecting forces, which occur during specialty application device handling such as the application of external images, and therefore the instant invention may be considered to possess a superior said secondary display plane.

Unfortunately once again in the case of chemiluminescent devices using the vast cavity design, experience uncontrolled surface curvature and deflection especially toward their unsupported center areas, which by comparison those surfaces are far inferior surfaces to attempt any form of repeatable and closely registered fine detailed external image application, such as multi-color imprints or precisely located adhered images.

A further advantage demonstrated in said device 1000 and said device 2000 is the use of the extended areas of said flange 34 to become the foundation for the support and exhibition of the instant invention. The numerous advantages of this said extended flange 35 is that the side that would normally be occupied by adhesive or fixing agents as used by others, may now be optionally used as another display area affording the potential of the device being used as a center piece type display.

Also the instant invention has demonstrated the advantage of a truly novel and imaginative use of this perimeter area which opens new and exciting ways of exhibiting such a device to effectively customize its application, from being part of a larger continuous display, to being part of modular system of snap together Nos. and letters, to being a button hole pendant, to being a wrist, waist, neck or head band, to being a stand alone sign, to being a continuous roll of shapes which may be cut to order, to being a coaster, to being inserted in a cardboard cut-out, the list is limited only to the possible shape, orifice, or formation achievable on this said extended flange 35.

Although the description of the instant invention above has demonstrated an effective and creative form of chemiluminescent exhibition containing many specificities, these should not be construed as limiting the scope of the instant invention but as merely providing illustrations of some of the presently preferred embodiments of this invention.

For example, the device may have other shapes, such as open or closed forms, convex or concave forms, trapezoidal, triangular, oval, figurine, etc., it may projects light from a single side or both sides, either shell may be opaque composite or laminated materials and omit any number of available features, features may be of any dimension and have semicircular or triangular cross section rather than rectangular or square, images may be imprinted on internal components, internal components may be extended and incorporated in the perimeter said impervious seal 32, inner areas of the said front shell 20 and said rear shell 22 may receive occasional spot welds for added support, interconnecting components may be incorporated or extend, from the surface area of said flange 34, total chemical isolation from either side may be achieved by extending and sealing another layer between said flange 34 of either said front shell 20 and said rear shell 22, this layer itself could have formed therein all the features used on said front shell 20 and said rear shell 22 in turn allowing said front shell 20 and rear said shell 22 to be flat in cross section, said glass vials 46 may be replaced by plastic film type containers, chemiluminescent viscosities or compounds may be varied, etc.

Thus the scope of the invention should be determined by the appended claims and their legal equivalents, rather than by the examples given.

I claim:

1. An artistic display device comprising, in combination:

a shell having a substantially flat front wall through which an optical image is to be transmitted, a rear wall substantially parallel to said front wall, said walls having peripheral edges secured together, and said walls also having perimetrical portions inside said peripheral edges that are positioned close together in parallel relationship;

said rear wall within said perimetrical portion thereof being also rearwardly recessed to form a compartment;

a body of liquid-absorbing material forming essentially a flat layer and having a perimetrical portion thereof disposed between and supported by said perimetrical portions of said walls;

a flat light control member disposed between said body of liquid-absorbing material and said front wall of said shell for modifying light that is generated from said body of liquid-absorbing material and transmitted through said front wall;

at least one set of frangible vials housed in said compartment containing respectively separate liquids, which vials may be broken so as to mix the liquids to provide a chemiluminescent light-generating mixture that will then saturate said body of liquid-absorbing material; and wherein said rear wall is additionally laterally recessed to provide a plurality of ducts radiating laterally outwardly from said compartment to aid in distributing the mixed liquid to said perimetrical portion of said body of liquid-absorbing material.

2. An artistic display device as in claim 1 wherein said rear wall has an upstanding flange adjacent its perimeter, said upstanding flange having an upper edge of said rear wall also having a peripheral flange extending laterally outwardly from the upper edge of said upstanding flange; the peripheral edge of said front wall being secured to said peripheral flange of said rear wall for retaining the liquid inside said shell after said vials have been broken.

3. An artistic display device as in claim 1 wherein said rear wall is outwardly recessed to form a plurality of separate compartments, each of said separate compartments containing a corresponding separate set of frangible vials.

4. An artistic display device comprising, in combination:

a shell having a substantially flat front wall through which an optical image is to be transmitted;

a body of liquid-absorbing material essentially in the shape of a flat layer and disposed parallel to said front wall and having a perimetrical portion that is disposed adjacent said front wall;

a flat light control member disposed between said body of liquid-absorbing material and said front wall of said shell;

said shell further having a rear wall disposed substantially parallel to said front wall, said rear wall having a perimetrical portion positioned in supporting relationship to said perimetrical portion of said body of liquid-absorbing material;

said rear wall being also rearwardly recessed inside said perimetrical portion to form at least one compartment containing a set of frangible vials having separate chemiluminescent liquids therein, so that when said vials are broken said body of liquid-absorbing material then continues to be supported in substantially its original flat configuration; and wherein said compartment has a lateral expanse that is substantially less than the lateral expanse of said body of liquid-absorbing material, said rear wall being additionally recessed to provide a plurality of ducts radiating laterally outwardly from said compartment to aid in distributing the mixed liquid to all portions of said body of liquid-absorbing material.

5. An artistic display device as in claim 4 wherein said rear wall has an upstanding flange adjacent its perimeter, said upstanding flange having an upper edge, said rear wall also having a peripheral flange extending laterally outwardly from the upper edge of said upstanding flange; the peripheral edge of said front wall being secured to said peripheral flange of said rear wall for retaining the liquid inside said shell after said vials have been broken.

6. An artistic display device as in claim 4 wherein said rear wall is outwardly recessed to form a plurality of separate compartments, each of said separate compartments containing a corresponding separate set of frangible vials.

7. In an artistic display device including a shell having a transparent front wall through which an optical image is to be transmitted, a rear wall forming in cooperation with the front wall a compartment, a set of frangible vials in the compartment having separate chemiluminescent liquids therein and which may be broken to mix the liquids and thereby provide a light-generating mixture for generating light, and a body of liquid-absorbing material for retaining the liquid mixture after the vials have been broken, the improvement comprising:

the front and rear walls having perimetrical portions between which a perimetrical portion of the body of liquid-absorbing material is grasped, for maintaining the shape of said body of liquid-absorbing material after the vials have been broken;

the size of the compartment being restricted to closely conform to the size of the vials so that the body of liquid-absorbing material has limited opportunity to migrate into the compartment; and wherein said compartment has a lateral expanse that is substantially less than the lateral expanse of said body of liquid-absorbing material, said rear wall being also recessed to provide a plurality of ducts radiating laterally outwardly from said compartment to aid in distributing the mixed liquid to all portions of said body of liquid-absorbing material.

8. The artistic display device of claim 7 that further includes a light control member disposed between the front wall and the body of liquid-absorbing material for modifying the light transmitted externally of the shell.

9. An artistic display device as in claim 7 wherein said rear wall is outwardly recessed to form a plurality of separate compartments, each of said separate compartments containing a corresponding separate set of frangible vials.

10. An artistic device as in claim 7 wherein said light control member covers only a small portion of said body liquid-absorbing material, a remaining portion of said body of liquid-absorbing material engaging an inner surface of said front wall.

11. An artistic device as in claim 7 wherein said rear wall has multiple portions thereof that are in contact with said body of liquid-absorbing material at other than its perimetrical portion, thus providing additional support for said body of liquid-absorbing material after said vials are broken.

* * * * *